US006083595A

United States Patent [19]

Zaginaylo et al.

[11] Patent Number: 6,083,595

[45] Date of Patent: Jul. 4, 2000

[54] WIDE WIDTH FLOORING SHEET

[75] Inventors: Leda Zaginaylo, Maytown; George L. Lilley, Manheim; W. Bruce Holland, Leola, all of Pa.

[73] Assignee: Armstrong World Industries, Inc., Lancaster, Pa.

[21] Appl. No.: 08/951,980

[22] Filed: Oct. 16, 1997

[51] Int. Cl.[7] ..... B32B 3/10

[52] U.S. Cl. ..... 428/54; 52/506.09; 52/506.1; 428/55; 428/56; 428/57

[58] Field of Search ..... 428/54, 55, 56, 428/57; 156/304.1; 52/506.09, 506.1

[56] References Cited

U.S. PATENT DOCUMENTS

| | | | |
|---|---|---|---|
| 1,984,928 | 12/1934 | Henkel | 156/266 |
| 3,607,576 | 9/1971 | Phillips | 156/507 |
| 3,630,803 | 12/1971 | Printz | 156/266 |
| 3,803,965 | 4/1974 | Alderfer | 83/155 |
| 4,087,308 | 5/1978 | Baugher et al. | 156/405 |
| 4,343,667 | 8/1982 | Hollis | 156/266 |
| 5,503,887 | 4/1996 | Diaz | 428/58 |

*Primary Examiner*—Nasser Ahmad
*Attorney, Agent, or Firm*—Womble Carlyle Sandridge & Rice, PLLC

[57] ABSTRACT

The disclosure is for a wide width decorative flooring product and a method of producing such a product with properly aligned patterns by cutting multiple sections of standard width product and bonding them together at their previous side edges, so the lengths of the cut sections become the width of the new product. In order to minimize misalignment of the pattern at the bonded edges alternate cut sections are turned end for end as the new product is laid out before bonding.

2 Claims, 1 Drawing Sheet

WIDE WIDTH FLOORING SHEET

BACKGROUND OF THE INVENTION

This invention deals generally with making sheet goods, and more specifically with the production of indefinite lengths of patterned sheet flooring product in widths much wider than are generally available.

The widths of decorative sheet flooring materials have generally been limited to about twelve feet because the machines which produce such flooring must be even wider than the product they produce, and twelve foot wide material is satisfactory for most applications. However, there is some demand for larger widths, and the demand appears to be increasing for such greater widths, particularly for the manufactured home industry.

Although some machines are built which produce greater widths, they are very large and expensive, and the capital cost is difficult to justify without a significant long range market for such extra width product. Furthermore, regardless of what greater width machine is selected, there may always be some market for product of even greater width.

The most obvious method of producing such wider product is simply to bond two or more narrow sheets together to form a wider sheet, but such a technique raises new problems. One problem is that the bond at which the narrow sheets meet usually has a slightly greater thickness than the adjacent product. Although this may not be a drawback during the actual use of the product on floors, since flooring is transported and sold in rolls, this slightly thicker seam causes a bulge on the roll where the seam is repetitively rolled up upon itself.

A more severe but subtle problem is the mismatching of patterns on two independently produced rolls of narrow material. Although the repetitive patterns on flooring material are reproduced accurately, stretching or shrinkage in the base material is not absolutely predictable, and it is virtually impossible to assure that patterns on the edges of two independently produced rolls of flooring material will exactly match over lengths of more than several feet. Therefore, while a seam running the full length between two narrow rolls of material may be barely perceptible once on the floor, the misalignment of two supposedly identical patterns over the length of the rolls will be so noticeable that a wider roll manufactured in such a manner is unusable.

Thus, until now manufacturers of patterned flooring who wanted to produce wider than usual product, had only one choice, that of purchasing a machine large enough to manufacture the width desired.

SUMMARY OF THE INVENTION

The present invention is a wide width repetitive pattern decorative flooring product and a method of producing such a product based on the use of multiple sections cut from narrower width decorative flooring material. The wide width patterned flooring product of the invention does not have a seam along its length to produce a bulge on the storage rolls, and it has virtually perfect matches at transverse seams regardless of the length of the wide width product. Furthermore, the width of the product can be varied over a wide range, and is essentially unlimited.

The wide width patterned flooring product of the invention is produced by cutting multiple equal length sections from a narrower width roll of material and forming seams by bonding the sections together at their previous edges so that the lengths of the cut sections become the width of the new product and the widths of the cut sections are added together to become the length of the new product.

With such a structure, the seams run transverse to the length of the product, and cause no bulge when the product is placed on a roll because the transverse seams do not consistently fall on top of other seams on the roll as with a seam along the length dimension.

The method of the invention also solves the problem of mismatched patterns because at each seam a match is only required for portions of the patterns of the original material which were separated no more than the distance of the length of the original cut sections. Experience has shown that the changes in patterns over such distances, 12 to 25 feet, are imperceptible for most patterns.

However, an alternate method of the invention provides an improvement in pattern matching over even the method described above. There is some possibility, because of slight skewing of the base material, that a pattern will be slightly shifted as it moves across the width of a roll, which can be twelve feet wide. Furthermore, sometimes shading and material thickness also vary slightly across the width of a roll, and the method described above actually matches opposite edges of the original roll at each seam so that such differences may be quite noticeable. To prevent such visible mismatches, an alternate method can be used to improve the match.

The alternate method assures that only the pattern from one edge of the original material will be used to provide the material for both sides of any seam on the new product. This is accomplished by the simple action of turning alternate original cut lengths end for end, so that the two sides of each cut made from the original narrow material are laid out adjacent to each other to form an edge on the new product. This technique means that each seam on the new product will be formed from edges which where not only cut from the same edge of the narrow original material, but that the two mating edges where also adjacent to each other on the original material.

The method of the invention thereby permits the production of patterned floor product of any desirable width, and assures that the decorative pattern on the new product will remain without visible discontinuities.

DETAILED DESCRIPTION OF THE INVENTION

Figure 1:
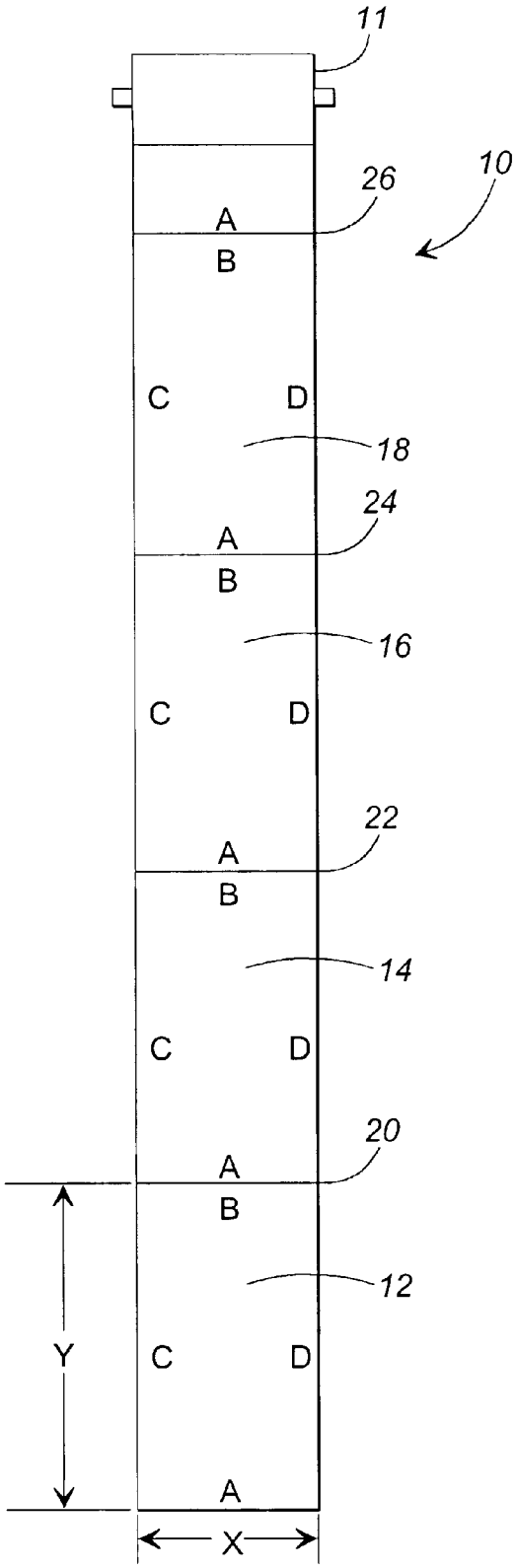
FIG. 1 is a schematic diagram of sections as they are cut from an original roll of patterned floor material.

FIG. 1 is a schematic diagram of the cuts made on original patterned material 10 of width X to form sections to be assembled into a wider width product. As original material 10 is unrolled from roll 11, sections 12, 14, 16, and 18 are cut to identical lengths Y. Length Y can be any measurement desired which is equal to or greater than the desired width of the floor product to be manufactured. However, because of the repeating pattern on original material 10, it is desirable to make each cut 20, 22, 24, and 26 in original material 10 at exactly the same location within the repeating pattern. If the cuts are not at the same location in the pattern, additional cuts are required before bonding in order to match the pattern for new wider product 30, and a quantity of material 10 is discarded.

As is shown on FIG. 1, one edge, the left one, on original material 10 is designated C, and the opposite edge is designated D for purposes of describing the present invention. Similarly, each of the cut sections 12, 14, 16, and 18 has a leading edge designated as A and a trailing edge designated as B.

When properly cut at the same locations in the repeating pattern, all leading edges A exactly match all trailing edges B. Moreover, since the repeat cycle of the original material in the transverse direction, from edge C to edge D, is also always manufactured with an integral number of cycles, all edges C also match all edges D. However, as discussed previously, these exact matches are only truly valid over a limited length of original material 10 because of some minor stretching and shrinking of the original base material during manufacture or variations in shading or the thickness of material.

Figure 2:
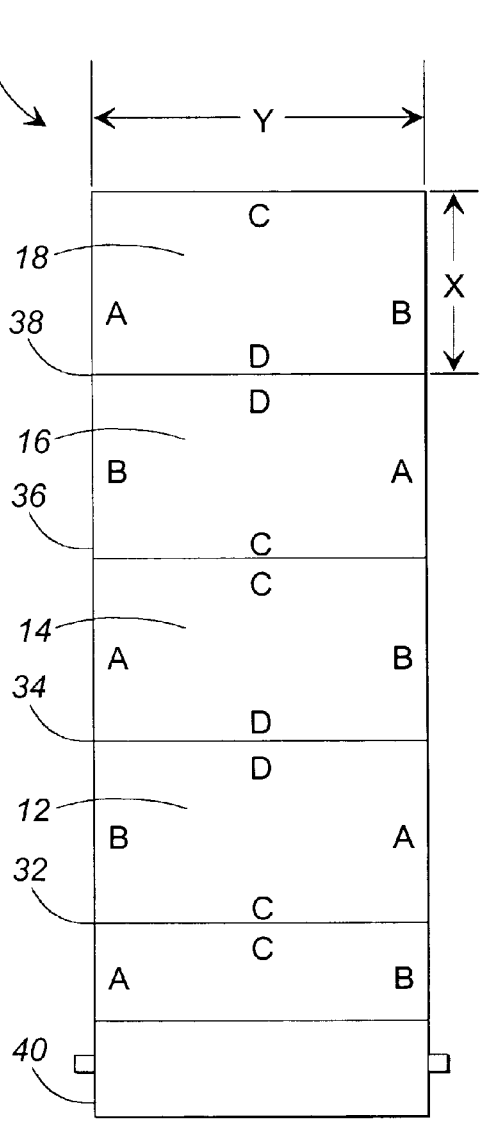
FIG. 2 is a schematic diagram of the manner in which the sections cut from the original material are laid out for the new floor product.

FIG. 2 is a schematic diagram of the manner in which sections 12, 14, 16, and 18, cut from original material 10, are laid out for new wide floor product 30. The sections are each turned 90 degrees, and former edges C and D are butted and bonded together to form new product 30 with width Y, which was the length dimension of the sections cut from the original material. The length of new wide product 30 is the sum total of the dimensions X of all the cut sections, which were originally the width of material 10. The methods of bonding together such sections of patterned floor product are well understood in the flooring industry and are not a part of this invention.

To counteract any possibility of mismatch of sections cut from separated locations on original material 10, sections 12, 14, 16, and 18 can be oriented in a particular fashion to form new wide product 30. Essentially, before the sections are laid out to form new wide product 30, every second section cut from original material 10 is turned 90 degrees in the opposite direction from which the previous section was turned. This results in alternate sections of new wide product 30 being turned 180 degrees from each other.

Thus, as can be seen in FIG. 2, each edge of new wide product 30 is formed of alternating edges A and B of original material 10, and each bonded seam 32, 34, 36, and 38 of new wide product 30 is made up of either two parts of former edge C or two parts of former edge D. Furthermore, when, as shown in FIG. 2, the cut sections are laid out in the new orientation in the same sequence as which they are cut from original material 10, each seam in new wide product 30 is made from edges which were adjacent to each other in original material 10. Such formerly adjacent edges will have the minimum possible deviation in the repeating pattern and the shading of the original material and minimum variation in the thickness of the base material.

Moreover, the resulting edges of the new wide product, which as shown in FIG. 2, are made up of alternating A and B portions of the cut sections, and that layout of the invention results in one half of the adjacent A and B edges actually being matching parts from both sides of cuts across original material 10. Even the A and B edges which are not opposite sides of an original cut were only separated originally by the distance of two Y dimensions, and are not likely to have any significant deviations.

As new wide product 30 is being produced it is desirable to roll it up upon roll 40 for storage and transportation. As can be appreciated from FIG. 2, the seams on wide product 30 are oriented across the length being rolled up onto roll 40, so that no significant number of seams can possibly fall atop one another. Therefore, no bulge will result even if the seams are slightly thicker than the material on either side of each seam.

Thus, the preferred embodiment of the method of the invention for producing a decorative sheet product of indeterminate length and predetermined width is:

a) making cuts on and trimming an original decorative sheet material which has a constant dimension between its side edges into equal length cut sections, with cut section lengths selected to be equal to a desired width of a decorative sheet product; and b) forming an indeterminate length of decorative sheet product by bonding the cut sections together so that bonds are butt joints between edges of the original material on cut sections which were adjacent to each other on the original material, and the cuts from the original material form continuous new edges.

The alternate embodiment of the method of the invention for producing a repeating pattern sheet product of indeterminate length and predetermined width is:

a) making cuts on and trimming an original decorative sheet material which has a constant dimension between its first side edge and its second side edge into equal length cut sections, with cut section lengths selected to be equal to a desired width of a decorative sheet product, and the cut sections formed with matching repeating patterns; and b) forming an indeterminate length of decorative sheet product by bonding the cut sections together so that bonds are butt joints between edges of the original material on cut sections which were adjacent to each other on the original material, the cuts from the original material form continuous new edges, and each bond is between parts of the edges of the original material which were from the same edge of the original material.

The present invention thereby furnishes a patterned sheet product of any desired width with a virtually perfect pattern match throughout the length of the sheet regardless of how long the product is, and also provides a method of making such a product.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed as new and for which Letters Patent of the United States are desired to be secured is:

1. A decorative sheet flooring product of indeterminate length and predetermined width comprising:

equal length rectangular sections cut from an original decorative sheet material with side edges, with cut section lengths selected to be equal to a desired width of a decorative sheet product, with the cut sections directly bonded together so that bonds are between edges of the original material on cut sections which were adjacent to each other on the original material, each bond is directly between parts of the edges of the original material which were from the same edge of the original material, and the cuts from the original material form continuous new side edges.

2. A repeating pattern sheet flooring product of indeterminate length and predetermined width comprising:

equal length sections cut from an original repeating pattern sheet material with a first side edge and a second side edge, with cut section lengths selected to be equal to a desired width of a repeating pattern sheet product, with the cut sections formed with matching repeating patterns, and with the cut sections directly bonded together so that bonds are between edges of the original material on cut sections which were adjacent to each other on the original material, the cuts from the original material form continuous new side edges, and each bond is between parts of the edges of the original material which were from the same edge of the original material.

* * * * *

UNITED STATES PATENT AND TRADEMARK OFFICE

CERTIFICATE OF CORRECTION

PATENT NO : 6,083,595

DATED : July 4, 2000

INVENTOR(S) : Zaginaylo et al.

It is certified that error appears in the above-identified patent and that said Letters Patent is hereby corrected as shown below:

At column 6, line 1, --directly-- should be inserted between "is" and "between".

Signed and Sealed this

Eighth Day of May, 2001

*Attest:*

Nicholas P. Godici

NICHOLAS P. GODICI

*Attesting Officer*

*Acting Director of the United States Patent and Trademark Office*